US007877038B2

(12) United States Patent
Kim et al.

(10) Patent No.: US 7,877,038 B2
(45) Date of Patent: Jan. 25, 2011

(54) IMAGE FORMING APPARATUS CAPABLE OF REDUCING TEMPERATURE DIFFERENCE OF A PHOTOSENSITIVE BODY

(75) Inventors: Jong-woo Kim, Yongin-si (KR); Hyun-ki Cho, Hanam-si (KR); Tae-hee Kim, Incheon (KR)

(73) Assignee: Samsung Electronics Co., Ltd., Suwon-Si (KR)

( * ) Notice: Subject to any disclaimer, the term of this patent is extended or adjusted under 35 U.S.C. 154(b) by 127 days.

(21) Appl. No.: 12/055,602

(22) Filed: Mar. 26, 2008

(65) Prior Publication Data

US 2008/0285998 A1 Nov. 20, 2008

(30) Foreign Application Priority Data

May 18, 2007 (KR) ..... 10-2007-0048705

(51) Int. Cl.
*G03G 15/00* (2006.01)
*G03G 21/20* (2006.01)

(52) U.S. Cl. ..... 399/92; 399/96; 399/167

(58) Field of Classification Search ..... 399/92, 399/94, 96, 107, 116, 117, 159, 167
See application file for complete search history.

(56) References Cited

U.S. PATENT DOCUMENTS

| | | | | |
|---|---|---|---|---|
| 4,484,812 | A * | 11/1984 | Takayanagi | 399/50 |
| 5,221,947 | A * | 6/1993 | Ndebi et al. | 219/469 |
| 6,148,633 | A * | 11/2000 | Yamada et al. | 62/347 |
| 7,433,624 | B2 * | 10/2008 | Ohkura | 399/92 |
| 7,603,060 | B2 * | 10/2009 | Arakawa | 399/167 |
| 2006/0029444 | A1 * | 2/2006 | Naito et al. | 399/329 |
| 2007/0147872 | A1 * | 6/2007 | Nakano | 399/88 |

FOREIGN PATENT DOCUMENTS

| | | | |
|---|---|---|---|
| JP | 01-179954 | A * | 7/1989 |
| JP | 05-265328 | A * | 10/1993 |

* cited by examiner

*Primary Examiner*—Sophia S Chen
(74) *Attorney, Agent, or Firm*—Staas & Halsey LLP

(57) ABSTRACT

An image forming apparatus includes: a photosensitive body; a driver to drive the photosensitive body; a supporting bracket to support the driver; and a heat insulator disposed between the supporting bracket and the driver to shield the photosensitive body from heat generated by the driver.

21 Claims, 8 Drawing Sheets

IMAGE FORMING APPARATUS CAPABLE OF REDUCING TEMPERATURE DIFFERENCE OF A PHOTOSENSITIVE BODY

CROSS-REFERENCE TO RELATED APPLICATIONS

This application claims the benefit of Korean Patent Application No. 2007-48705, filed May 18, 2007, in the Korean Intellectual Property Office, the disclosure of which is incorporated herein by reference.

BACKGROUND OF THE INVENTION

1. Field of the Invention

Aspects of the present invention relate to an image forming apparatus, and more particularly, to an image forming apparatus capable of reducing a temperature difference of a photosensitive body.

2. Description of the Related Art

An image forming apparatus forms a predetermined image on a printing medium and may be generally classified as one of an inkjet type and an electrophotographic type according to the method by which the image forming apparatus forms images. The electrophotographic image forming apparatus generally forms an image through charging, exposing, developing, transferring, cleaning, and discharging operations. The electrophotographic image forming apparatus includes a photocopier, a laser printer, and the like.

As shown in FIG. 1, a conventional electrophotograhic image forming apparatus 1 includes a photosensitive body 5; a photosensitive body frame 4, which rotatably supports a rotation shaft 5*a* of the photosensitive body 5; and a driver 2 which rotatably drives the photosensitive body 5. A first end part of the rotation shaft 5*a* of the photosensitive body 5 is connected with a photosensitive body driving gear 5*b*. An electrostatic latent image is formed on the photosensitive body 5 corresponding to image information. The formed image is developed with a toner by a developing cartridge (not shown). A remaining toner on the surface of the photosensitive body 5 is stored in a scrapped toner container 6 after the formed image transfers to a print paper.

The driver 2 is supported by a supporting bracket 3. A rotation shaft 2*a* of the driver 2 is connected with a driving pinion 2*b*. The driving pinion 2*b* is engaged with a first gear train of a transmission gear 7. The photosensitive body driving gear 5*b* is engaged with a second gear train of the transmission gear 7 to transmit driving force of the driver 2 to the photosensitive body 5.

The supporting bracket 3 includes a metal material, and heat generated from the driver 2 is conducted directly to the supporting bracket 3. Thus, significant difference in surface temperature is produced between the two sides of the photosensitive body 5 as the side of the photosensitive body 5 nearest the driver 2 is heated by the heat generated by driver 2.

Temperatures at seven points, from point A to point G, were measured after operating the conventional image forming apparatus 1 for six consecutive hours resulting in the following Table 1. An initial temperature of the respective points was 23.5° C. The temperatures of the points A and G correspond to those of the photosensitive body frame 4. The temperatures of the points B to F refer to surface temperatures of the photosensitive body 5.

TABLE 1

| | Point | | | | | | |
|---|---|---|---|---|---|---|---|
| | A | B | C | D | E | F | G |
| Temp. | 58.7° C. | 55.6° C. | 54.9° C. | 54.5° C. | 54.3° C. | 53.0° C. | 49.6° C. |

If the surface temperature of the photosensitive body 5 rises, a residual surface potential of the photosensitive body 5 rises by approximately 50V to thereby reduce a potential difference between a developing roller (not shown) of the developing cartridge. The reduced potential difference decreases the amount of the toner moving to the photosensitive body 5 from the developing roller to thereby lower a density of an image.

As shown in Table 1, a maximum surface temperature difference of approximately 3° C. occurs between points B and F of the photosensitive body 5, thereby causing the density of the image formed at points B and F to be different.

Other than the temperature difference of the photosensitive body 5, temperature difference also occurs in the developing cartridge disposed adjacently to the photosensitive body 5, which develops the photosensitive body 5 with the toner. Thus, flow properties of the toner stored in the developing cartridges (not shown) are changed to thereby further decrease quality of the image.

If a forced cooling means, such as a cooling fan (not shown), is used, it becomes difficult to manufacture a light and small image forming apparatus. As such, it is necessary to find a different solution to address the temperature difference between the two ends of the photo sensitive body 5.

SUMMARY OF THE INVENTION

Accordingly, it is an aspect of the present invention to provide an image forming apparatus which is capable of reducing temperature difference of a photosensitive body.

Also, it is another aspect of the present invention to provide an image forming apparatus which improves quality of an image.

Further, it is another aspect of the present invention to provide an image forming apparatus which minimizes temperature difference in a photosensitive body without using a forced cooling means such as a cooling fan.

Additional aspects and/or advantages of the present invention will be set forth in part in the description which follows and, in part, will be obvious from the description, or may be learned by practice of the present invention.

Aspects of the present invention provide an image forming apparatus, including: a photosensitive body; a driver which drives the photosensitive body; a supporting bracket which supports the driver; and a heat insulator which is disposed between the supporting bracket and the driver.

According to an aspect of the invention, the supporting bracket is made of a metal material.

According to an aspect of the invention, the photosensitive body includes a photosensitive drum, the supporting bracket is disposed between the driver and the photosensitive body, and the driver is disposed in one side of an axial direction of the photosensitive body.

According to an aspect of the invention, the heat insulator is made of plastic.

According to an aspect of the invention, the photosensitive body includes a photosensitive drum, the supporting bracket is disposed between the driver and the photosensitive body, and the driver is disposed in one side of an axial direction of the photosensitive body.

According to an aspect of the invention, the image forming apparatus further includes a casing which accommodates the driver therein and includes an air ventilator to circulate air.

According to an aspect of the invention, the air ventilator includes an air inlet which is disposed in a position below the driver to introduce external air therethrough, and an air outlet which faces the air inlet and discharges internal air to the outside.

According to an aspect of the invention, the supporting bracket includes a bracket piece which protrudes toward the driver, and the heat insulator is injection-molded in the bracket piece by plastic.

According to an aspect of the invention, the supporting bracket is made of plastic, and the heat insulator is integrally formed with the supporting bracket.

BRIEF DESCRIPTION OF THE DRAWINGS

These and/or other aspects and advantages of the invention will become apparent and more readily appreciated from the following description of the embodiments, taken in conjunction with the accompanying drawings of which.

DETAILED DESCRIPTION OF THE EMBODIMENTS

Figure 1:
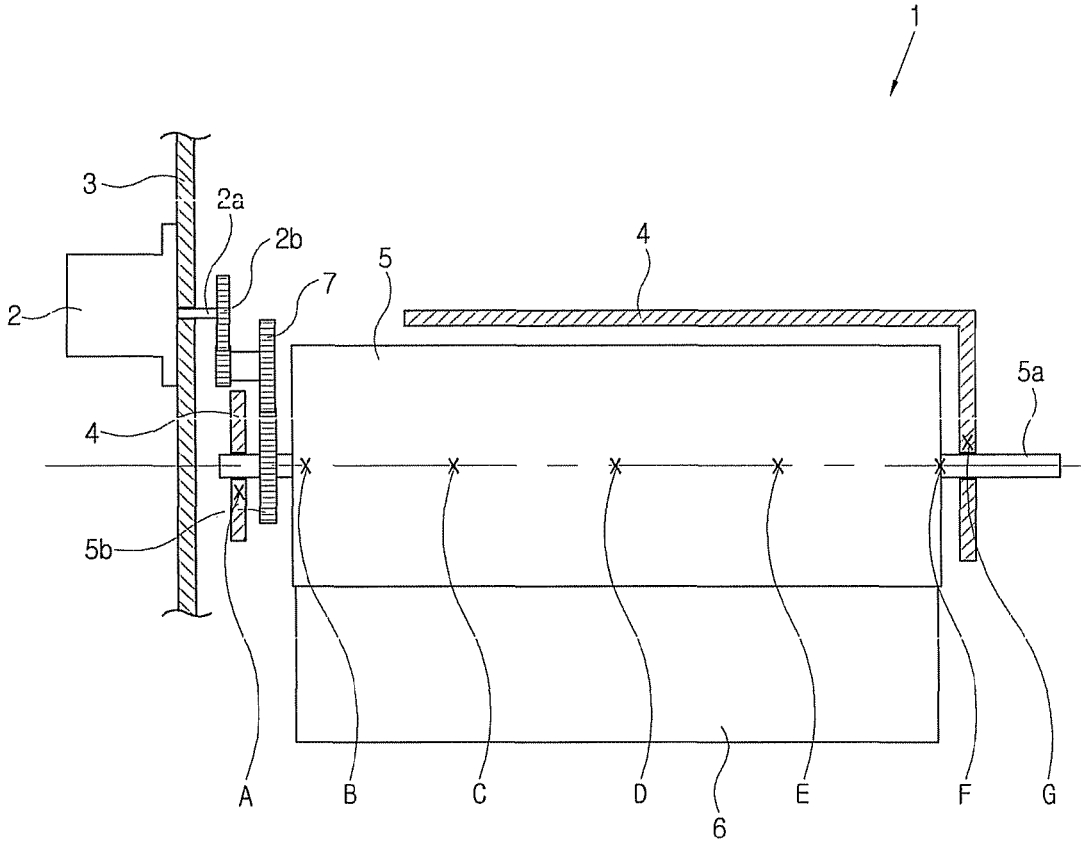
FIG. 1 (RELATED ART)
FIG. 1 is a cross-sectional view of a photosensitive body and a driver of a conventional image forming apparatus.

Reference will now be made in detail to the present embodiments of the present invention, examples of which are illustrated in the accompanying drawings, wherein like reference numerals refer to the like elements throughout. The embodiments are described below in order to explain the present invention by referring to the figures.

Figure 2:
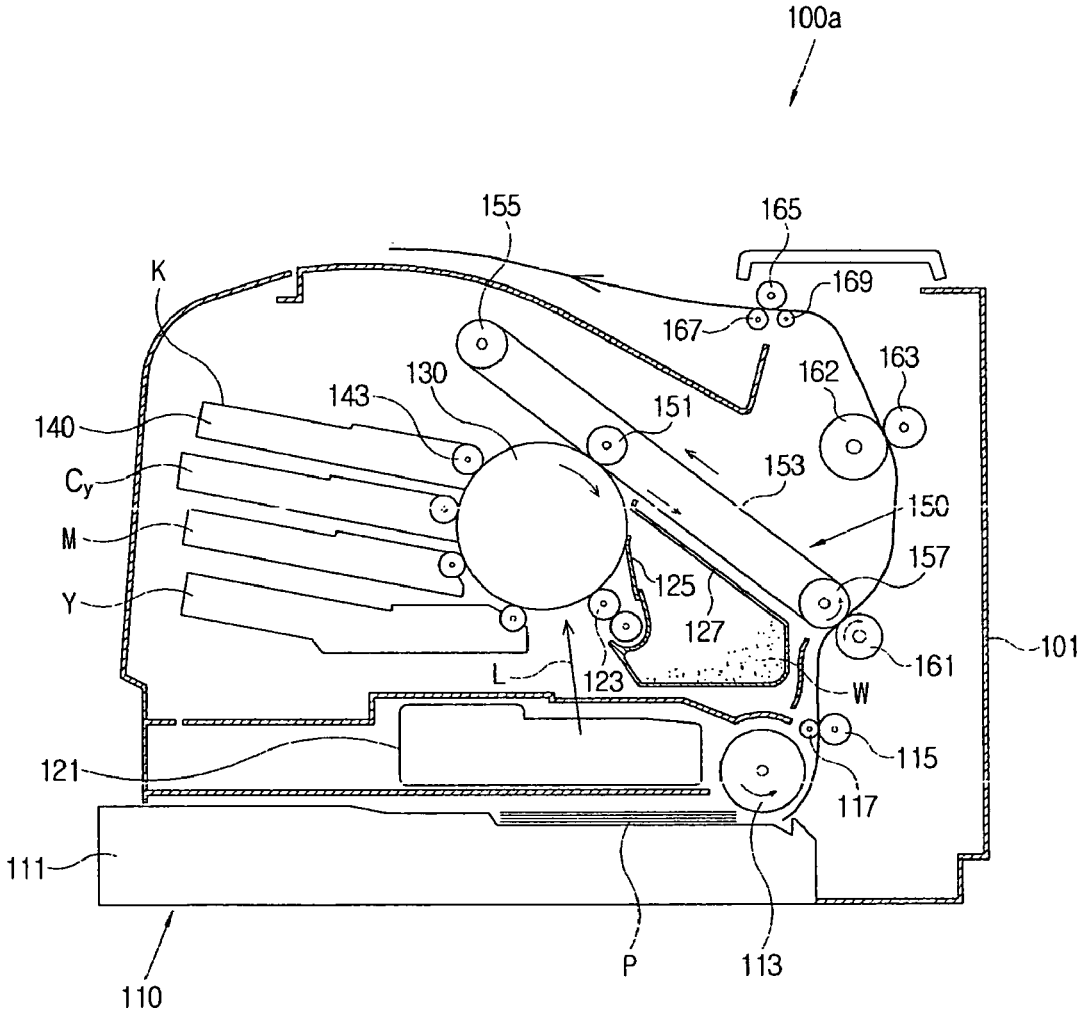
FIG. 2 is a schematic cross-sectional view of an image forming apparatus according to aspects of the present invention.

As shown in FIG. 2, an image forming apparatus 100*a* according to aspects of the present invention includes a casing 101; a paper feeder 110 which feeds a printing medium P; an exposing unit 121; a photosensitive body 130; a charger 123, which charges a surface of the photosensitive body 130; a plurality of developing cartridges 140, which store various toners to develop the photosensitive body 130; a transfer belt unit 150; and a second transfer roller 161. However, it is understood that other configurations can be used. For instance, only one cartridge 140 need be used for a monocolor printer. Moreover, other colors can be used, and other numbers of cartridges 140 can be used according to other aspects.

The paper feeder 110 includes a cassette 111, which stores the printing medium P therein; a pickup roller 113, which picks up the stored printing medium P; and registration rollers 115 and 117, which arrange the picked-up printing medium P and move the printing medium P to the transfer belt unit 150. The exposing unit 121 exposes light L corresponding to image information to the surface of the photosensitive body 130 to form an electrostatic latent image thereon.

The photosensitive body 130 may include a photosensitive drum. Alternatively, the photosensitive body 130 may include a belt. The photosensitive body 130 may vary as long as the electrostatic latent image is formed thereon and transferable to a printable medium.

The shown developing cartridges 140 are plurally provided to respectively store yellow toner Y, magenta toner M, cyan toner Cy, and black toner K. Some of the developing cartridges 140 may be used as necessary to produce full color images or black and white images. The developing cartridges 140 are detachably attached within the casing 101. A developing roller 143 is provided in one side of the respective developing cartridges 140 to develop the photosensitive body 130 with the stored yellow toner Y, magenta toner M, cyan toner Cy, and black toner K.

The transfer belt unit 150 includes a transfer belt 153; a pair of belt driving rollers 155 and 157, which rotate the transfer belt 153; and a first transfer roller 151. The first transfer roller 151 is provided adjacent to the photosensitive body 130 so that the transfer belt 153 is disposed therebetween and transfers a visible toner image formed on the photosensitive body 130 to the transfer belt 153. The second transfer roller 161 transfers the visible toner image formed on the transfer belt 153 to the printing medium P. In this case, the second transfer roller 161 may transfer the visible toner image from the transfer 153 to the printing medium P by producing a potential difference between to the belt driving roller 157 and the second transfer roller 161. Hereinafter, a color printing operation of the image forming apparatus 100a according to aspects of the present invention will be described.

First, the surface of the photosensitive body 130 is charged by the charger 123 to have a uniform surface potential. The exposing unit 121 exposes light corresponding to yellow image information to the photosensitive body 130. Thus, the electrostatic latent image is formed on the surface of the photosensitive body 130 by the potential difference between an exposed area and a non-exposed area. The electrostatic latent image is developed with the yellow toner Y by the yellow developing cartridge 140 to become a yellow toner image.

The yellow toner image is transferred to the transfer belt 153 by the first transfer roller 151. The remaining toner on the surface of the photosensitive body 130 is removed by a cleaning blade 125 and stored as waste toner W in a scrapped toner container 127.

Then, the surface of the photosensitive body 130 is charged by the charger 123 again. The exposing unit 121 exposes light corresponding to magenta image information to the photosensitive body 130. The magenta developing cartridge 140M develops the photosensitive body 130, and a magenta toner image is formed on the surface of the photosensitive body 130. The magenta toner image is transferred by the first transfer roller 151 and overlapped to the transfer belt 153 having the yellow toner image to overlap the yellow toner image.

A cyan toner image is formed in the same manner using the toner cartridge 140Cy and transferred by the first transfer roller 151 to the transfer belt 153 having overlapped yellow and magenta toner images to overlap the yellow and magenta toner images. Thus, three different toners overlap each other to form a color toner image on the transfer belt 153. However, the color toner image need not be limited to only three toners. Similarly, a black toner image can be formed using the cartridge 140K having black toner.

The printing medium P stored in the paper feeder 110 is picked up by the pickup roller 113 and its leading edge is arranged by the registration rollers 115 and 117. The arranged printing medium P is moved between the transfer belt 153 and the second transfer roller 161 at a proper timing for the color toner image to be transferred to the printing medium P.

The color toner image is fixed to the printing medium P by heat and pressure applied from a heat roller 162 and a press roller 163 to thereby complete the printing operation. The printed printing medium P is discharged outside of the casing 101 by discharging rollers 165, 167, and 169.

Figure 3:
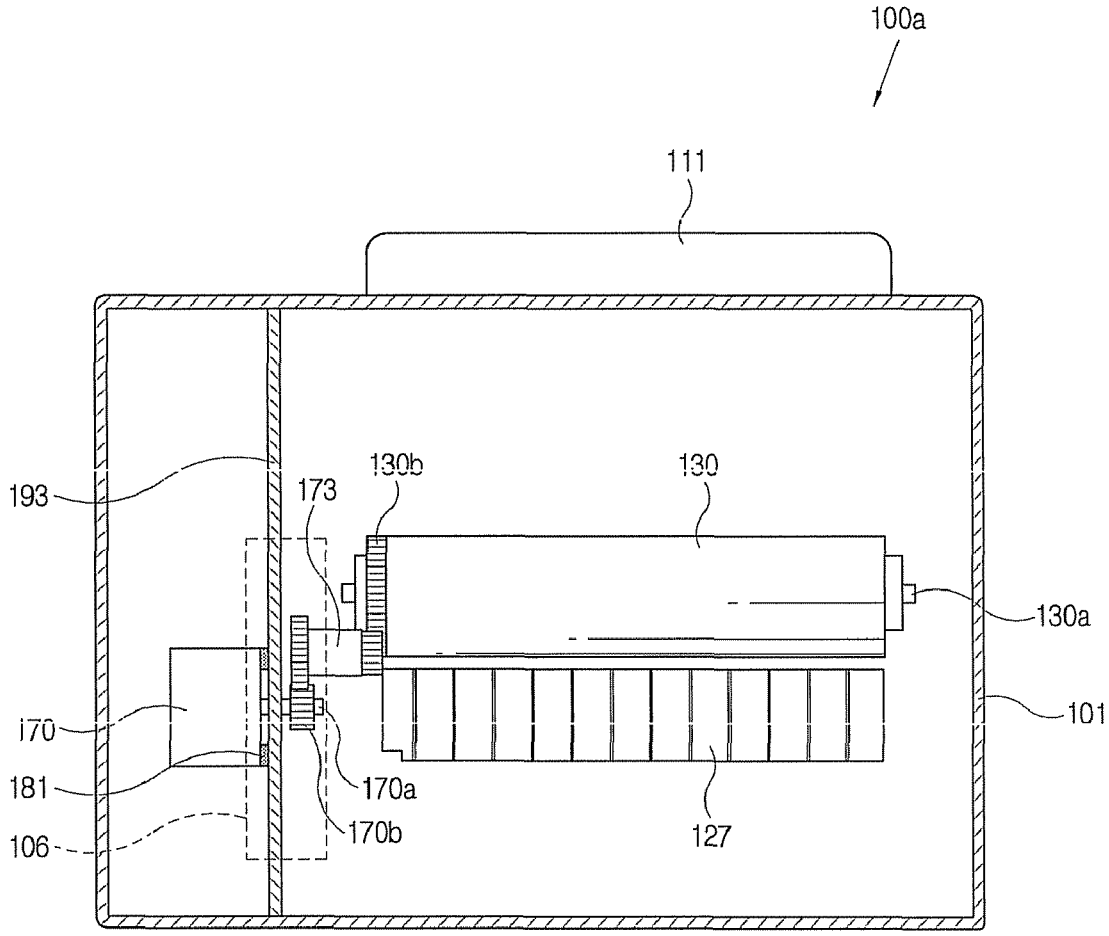
FIG. 3 is a schematic sectional view of the image forming apparatus in FIG. 1.

FIG. 3 is a top sectional view of the image forming apparatus 100*a* in FIG. 2, excluding the transfer belt unit 150 for illustrative clarity. As shown in FIG. 3, the image forming apparatus 100*a* according to aspects of the present invention includes a driver 170; a supporting bracket 193, which supports the driver 170; and a heat insulator 181. The driver 170 may include an electric motor. A rotation shaft 170*a* of the driver 170 is connected with a driving pinion 170*b*. As shown in FIG. 3, the driver 170 may be provided at one end of an axial direction of the photosensitive body 130. However, it is understood that the driver 170 is disposed at one side of the photosensitive body 130 when the photosensitive body 130 is in the form of a photosensitive belt.

An end part of a rotation shaft 130*a* of the photosensitive body 130 is connected with a photosensitive body driving gear 130*b* which receives driving force from the driver 170 and drives the photosensitive body 130. A transmission gear 173 is provided between the photosensitive body driving gear 130*b* and the driving pinion 170*b* and transmits the driving force of the driver 170 to the photosensitive body 130.

The supporting bracket 193 includes a metal material. The supporting bracket 193 not only supports the driver 170, but also rotatably supports a plurality of gears (not shown) driving rotating bodies. Examples of the rotating bodies include, with reference to FIG. 2, the heat roller 162, the press roller 163, and the belt driving rollers 155 and 157 as well as the receptor 130.

The heat insulator 181 is provided between the driver 170 and the supporting bracket 193 to block heat transfer from the driver 170 to the supporting bracket 193. The heat insulator 181 includes an insulating material and may include plastic. However, it is understood that the heat insulator 181 may be provided between the photosensitive body 130 and the supporting bracket 193, on both sides of the supporting bracket 193, or between the photosensitive body 130 and the driver 170. Further, the insulator can be of other insulative materials.

The driver 170, the heat insulator 181, and the supporting bracket 193 may be coupled with each other through a coupler (not shown). Alternatively, the driver 170, the heat insulator 181, and the supporting bracket 193 may be coupled with each other by an adhesive as necessary.

Figure 4:
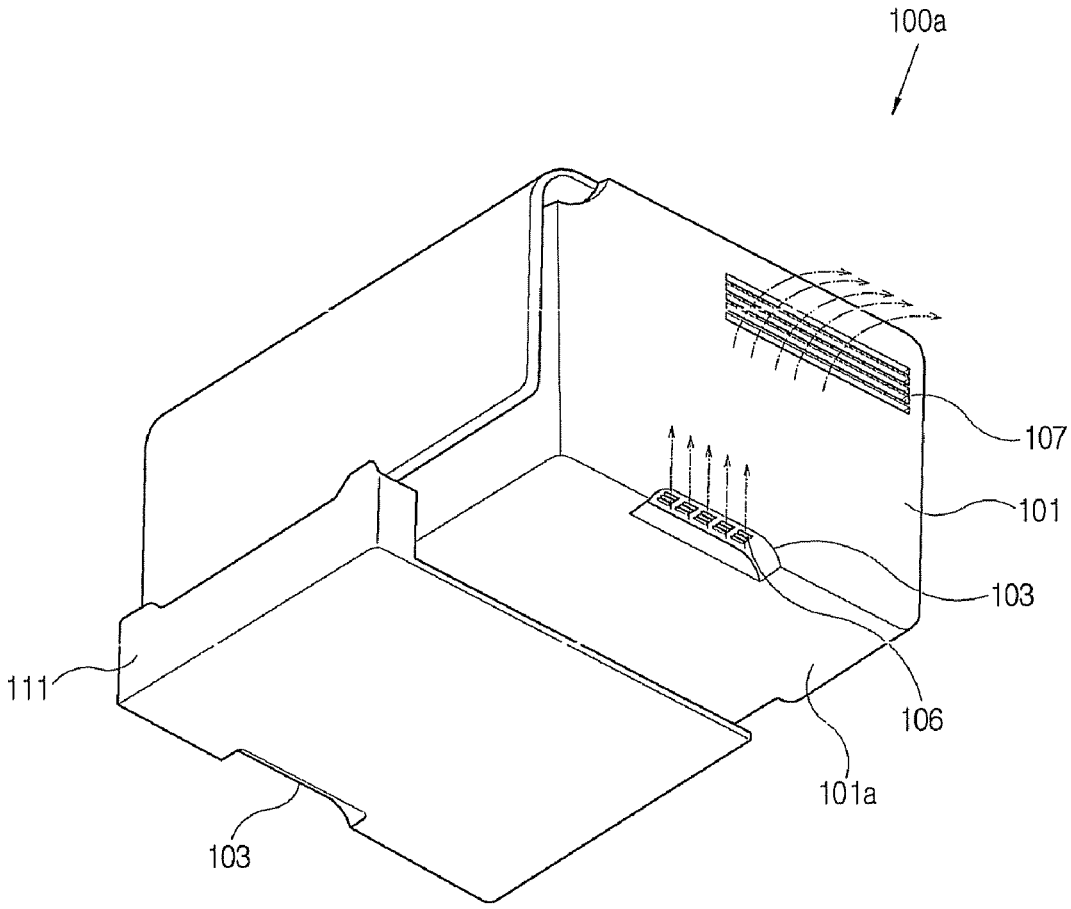
FIG. 4 is a rear perspective view of the image forming apparatus in FIG. 2.

As shown in FIGS. 3 and 4, an air inlet 106 and an air outlet 107 are provided in the casing 101. The air inlet 106 is provided in a lower position below the driver 170 while the air outlet 107 is provided in an upper position above the driver 170. External air, which has a relatively lower temperature, is introduced through the air inlet 106 to cool the driver 170 and then discharged to the outside through the air outlet 107. Thus, the driver 170 may be cooled by natural convection without a forced cooling device, such as a cooling fan. Accordingly, as shown in FIG. 3, external air may be introduced efficiently through the air inlet 106 provided in the lower position below the driver 170.

Alternatively, as shown in FIG. 4, the air inlet 106 may be provided in a gripping part 103. The gripping part 103 is gripped by a user when the image forming apparatus 100*a* is moved. The gripping part 103 may include a concave part which is provided in the lower part of the casing 101 as shown, or can be otherwise shaped. Further, the gripping part 103 need not be used in all aspects.

If the air inlet 106 is provided in a bottom surface 101*a* of the casing 101 instead of the gripping part 103, it may be beneficial to provide an additional separation between the bottom surface 101 a of the casing 101 from an installation surface on which the image forming apparatus 100*a* is placed to thereby allow external air to be introduced without difficulty. Instead, as shown in FIG. 4, the air inlet 106 is provided in the gripping part 103 so that the air inlet 106 is not directly disposed on the installation surface.

As shown in FIG. 4, the air outlet 107 may be formed in a side of the casing 101. The air outlet 107 also may be formed in the upper part of the casing 101 opposite the air inlet 106 in addition to or instead of on the side as shown.

Figure 5:
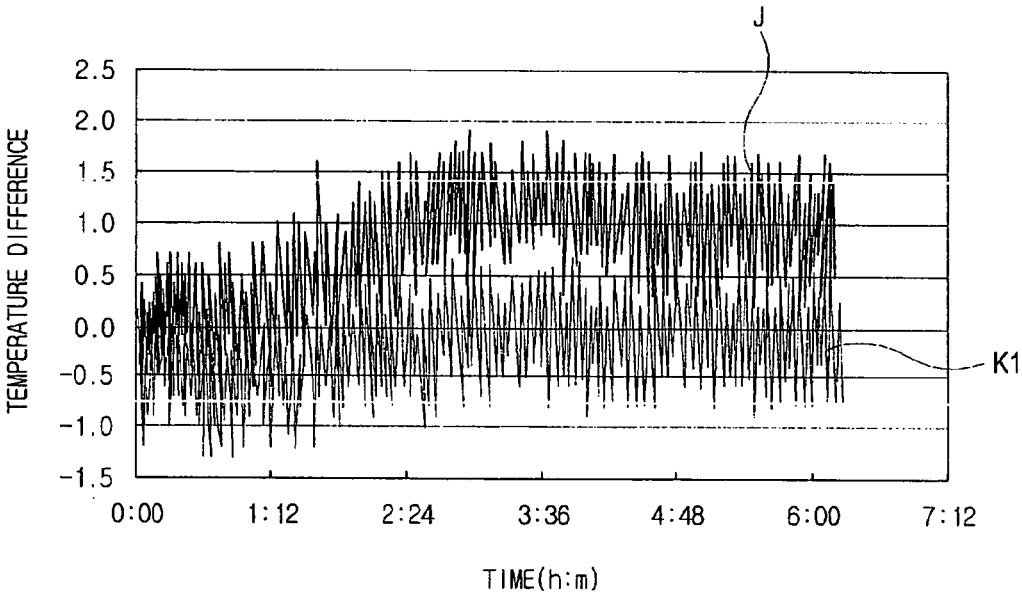
FIG. 5 is a graph which compares temperature differences of a photosensitive body of the conventional image forming apparatus in FIG. 1 and a photosensitive body of the image forming apparatus in FIG. 2 versus time.

FIG. 5 is a graph which illustrates a temperature difference between the two sides of the photosensitive body 130 (refer to 5 of FIG.1, and 130 of FIG. 3) measured according to time (i.e., the temperature difference between point B and point F as illustrated in FIG. 1 measured over time while the conventional image forming apparatus 1 and the image forming apparatus 100*a* according to aspects of the present invention perform printing operations for approximately six consecutive hours. Graph J is a temperature difference graph of the photosensitive body 5 of the conventional image forming apparatus 1 (refer to FIG. 1) and Graph K1 is a temperature difference graph of the photosensitive body 130 of the image forming apparatus 100*a* (refer to FIG. 3) according to aspects of the present invention.

Here, the temperature differences are illustrated in degrees Celsius. A positive (+) value of the temperature difference means that temperature of the surface of the photosensitive bodies 5 and 130 closest to the driver 170 (i.e., point B in FIG. 1) is higher than that of the surface of the photosensitive bodies 5 and 130 farthest from the driver 170 (i.e., point F in FIG. 1). Conversely, the negative (−) value of the temperature difference means that the surface temperature of the photosensitive bodies 5 and 130 closest to the driver 170 (i.e., point B in FIG. 1) is lower than that of the photosensitive bodies 5 and 130 farthest from the driver 170 (i.e., point F in FIG. 1).

According to graph J, for the conventional image forming apparatus 1, the temperature difference had a maximum of about (+) 2° C., a minimum of about (−) 1.1° C., and an average of (+) 1° C. According to Graph K1 for the image forming apparatus 100*a* according to aspects of the present invention, the temperature difference has a maximum of about (+) 0.5° C., a minimum of about (−) 1.2° C., and average of about (−) 0.2° C.

The conventional image forming apparatus 1 demonstrated about a 3° C. temperature difference from the minimum temperature (−) 1° C. to the maximum temperature (+) 2° C. while the image forming apparatus 100*a* according to aspects of the present invention demonstrated a 1.7° C. temperature difference from the minimum temperature (−) 1.2° C. to the maximum temperature (+) 0.5° C. to. That is, the image forming apparatus 100*a* demonstrated a decreased temperature difference by as much as 1.3° C. as compared to the conventional image forming apparatus 1.

The average temperature difference of the image forming apparatus 100*a* according to aspects of the present invention between point B and point F as illustrated in FIG. 1 was (−) 0.2° C., a decrease of almost 1° C. from the average temperature difference (+) 1.1° C. of the conventional image forming apparatus 1.

As described above, the image forming apparatus 100*a* according to aspects of the present invention may cool the inside without a forced cooling device, such as a cooling fan, and particularly, may decrease the temperature difference of the photosensitive body 130 in the axial direction.

Other than reducing the temperature difference in the axial direction of the photosensitive body 130, the image forming apparatus 100*a* according to aspects of the present invention may also reduce the temperature difference of the developing cartridges 140 disposed adjacent to the photosensitive body 130 in a similar manner. Thus, the flow properties of the toner stored in the developing cartridges 140 are maintained according to temperature to thereby minimize the density difference of the image formed on the printing medium P.

Figure 6:
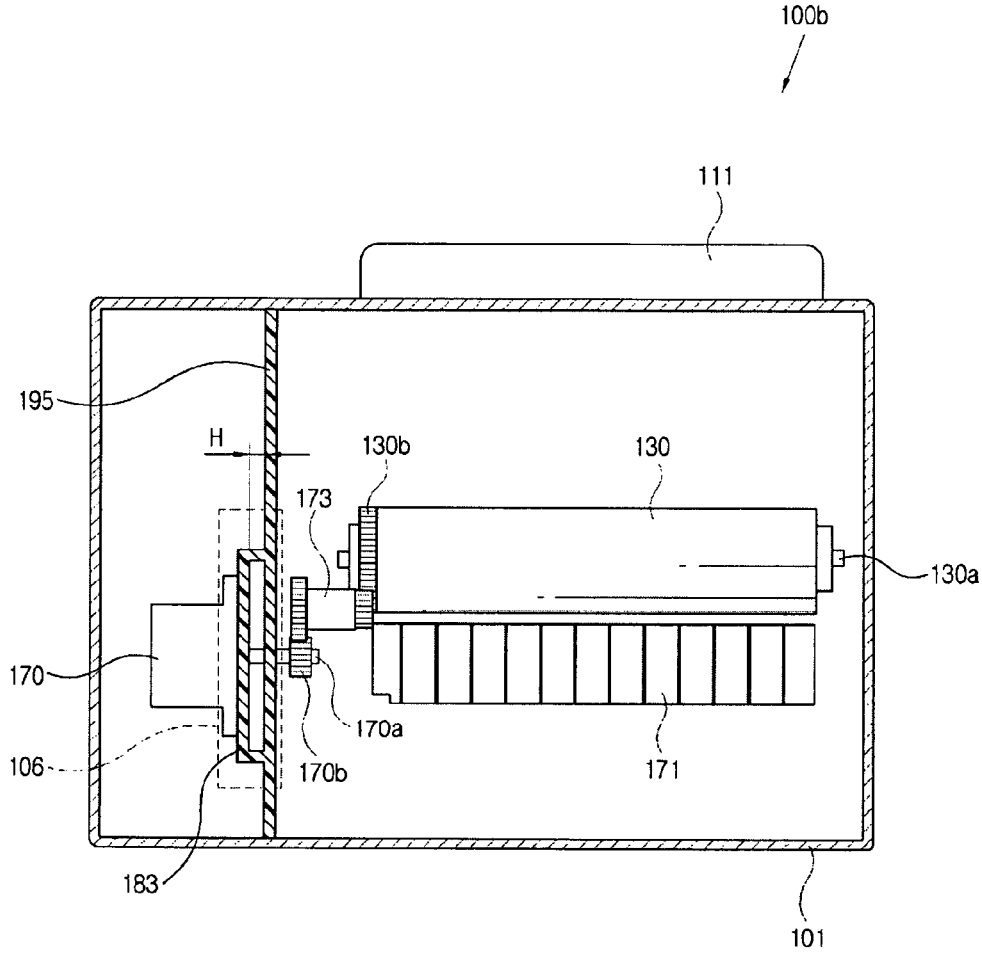
FIG. 6 is a schematic sectional view of an image forming apparatus according to aspects of the present invention.

FIG. 6 illustrates an image forming apparatus 100*b* according to aspects of the present invention. Hereinafter, elements which are different from those of the image forming apparatus 100*a* of FIG. 2 will be described. The remaining like number elements perform similar functions as described with reference to FIG. 2 such that a description thereof will be omitted.

The image forming apparatus 100*b* according to aspects as shown in FIG. 6 includes a supporting bracket 195 and a heat insulator 183. The supporting bracket 195 includes an insulating material. The supporting bracket 195 may include plastic, but can be of other insulative materials.

The heat insulator 183 may be integrally formed with the supporting bracket 195 and formed of the same material as the supporting bracket 195. That is, the supporting bracket 195 and the heat insulator 183 may be integrally formed by injection molding plastic.

An interval H may be formed between the heat insulator 183 and the supporting bracket 195. The interval H provides a channel through which air may flow, for example from the air inlet 106 to the air outlet 171, to cool the driver 170. The heat insulator 183 in FIG. 6 is locally provided in an area where the driver 170 is installed but may be disposed across an entire area of the supporting bracket 195, or disposed as necessary.

The interval H comprises insulating layer filled with air to minimize heat transfer from the driver 170 to the supporting bracket 195 through convection and/or conduction. Also, the interval H allows external air introduced from the air inlet 106 to pass. As the external air passes through the interval H, the heat insulator 183 and the supporting bracket 195 transport heat away from the driver 170 so as to decrease heat transfer to the photosensitive body 130. The interval H may include cooling fins or cooling paths through which the external air may travel so as to increase cooling efficiency of the external air.

The interval H in FIG. 6 has upper and lower parts which are open in a vertical direction with respect to an installation of the case 101 of the image forming apparatus 100*b* so that the external air introduced by the air inlet 106 passes therethrough and out of the air outlet 171. However, air may be injected into the interval H and the upper and lower parts thereof are closed so that the air remains within the interval H to form an insulating layer of air. Further, it is understood that air need not be used in all aspects such that the interval H may be filled with a gas having lower thermal conductivity than air. Moreover, the interval H may be evacuated so as to form an insulative vacuum.

If the interval H is too large, the rotation shaft 170*a* of the driver 170 may vibrate excessively. If the interval H is too small, the photosensitive body 130 may not be sufficiently insulated from the driver 170. Thus, the interval H may have a proper size, for example, approximately 4 mm.

Figure 7:
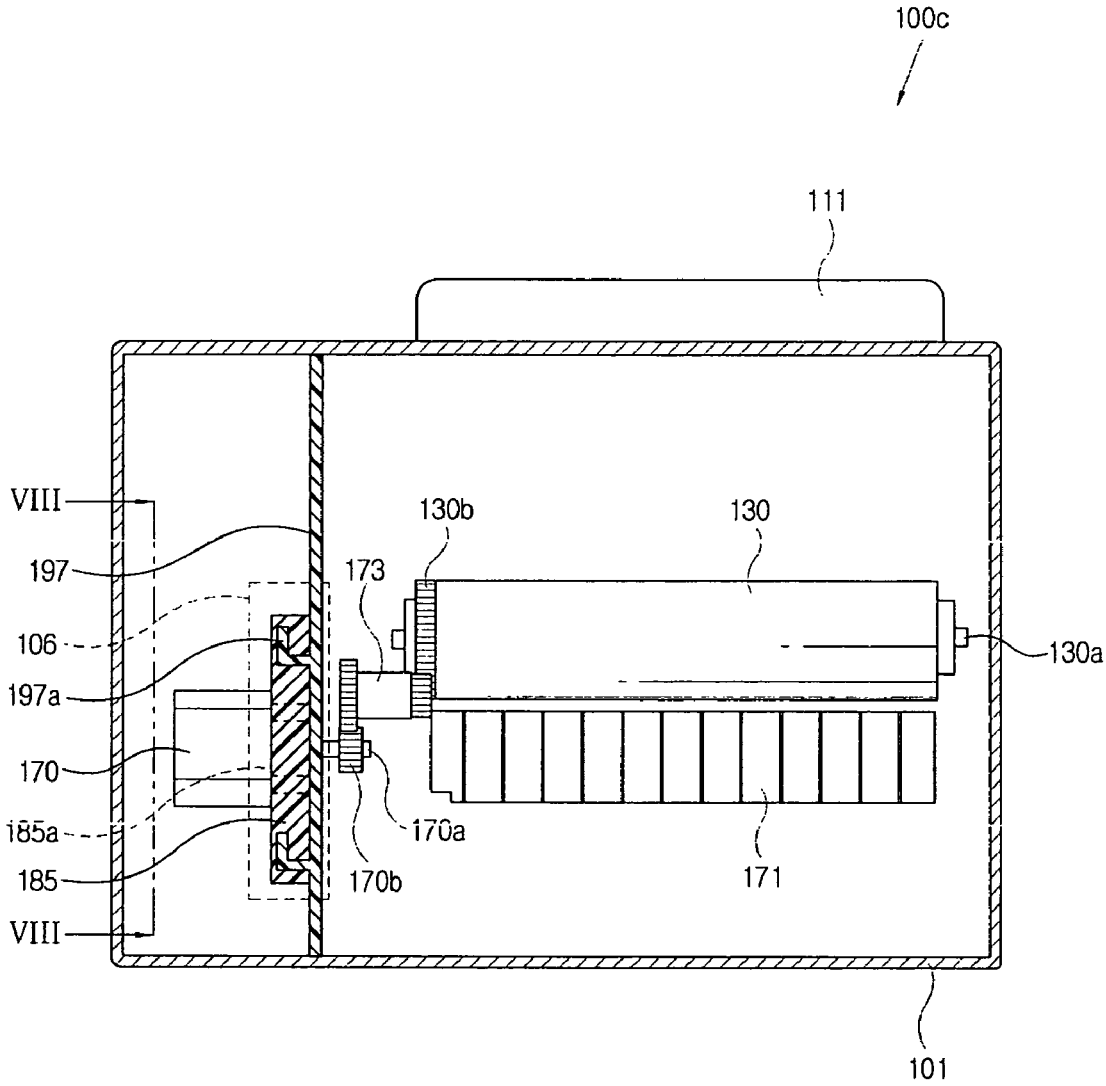
FIG. 7 is a schematic sectional view of an image forming apparatus according to aspects of the present invention.
Figure 8:
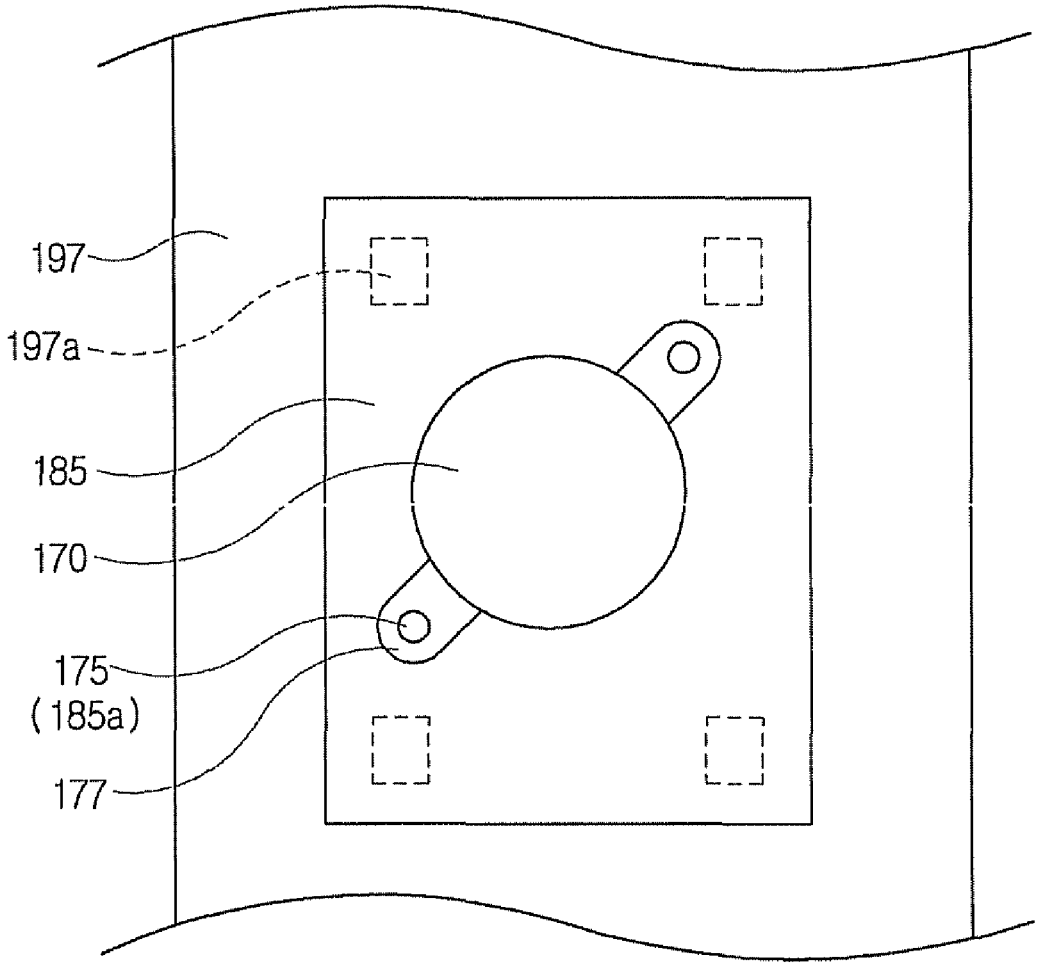
FIG. 8 is a schematic cross-sectional view of the image forming apparatus, taken along line VIII-VIII in FIG. 7.

As shown in FIGS. 7 and 8, an image forming apparatus 100*c* according to aspects of the present invention includes a supporting bracket 197 and a heat insulator 185. Other elements are similar to those of the image forming apparatus 100*a* according to aspects of the present invention as shown in FIG. 2. Thus, the detailed description thereof will be omitted here.

As shown in FIGS. 7 and 8, the supporting bracket 197 includes a bracket piece 197*a*. The supporting bracket 197 may be formed of a metal material. The supporting bracket 197 may be formed of a galvanized steel sheet.

As shown in FIG. 7, the bracket piece 197*a* is provided to protrude from the supporting bracket 197 toward a driver 170, and an end of the bracket piece 197*a* is bent upward with reference to the sectional view, FIG. 7. Further, the bracket piece 197*a* may be plurally provided. The bracket piece 197*a* may have a bent shape by press working or stamping. The bracket piece 197*a* may have a different shape such that the bracket piece 197*a* is convex toward the driver 170, as necessary, so as to curve to support the heat insulator 185. The bracket piece 197*a* may have various shapes as long as it supports the heat insulator 185.

The heat insulator 185 may be formed by an insert molding in a supporting bracket 197 corresponding to an area in which the driver 170 is disposed. That is, the bracket piece 197*a* of the supporting bracket 197 is inserted into a mold and then resin is ejected to thereby form the heat insulator 185 of a plastic or of other insulative materials.

A rotation shaft through hole (not shown) is formed in the supporting bracket 197 and the heat insulator 185 so that a rotation shaft 170*a* of the driver 170 passes through the supporting bracket 197 and the heat insulator 185. A coupler hole 185*a* is formed in the heat insulator 185 to connect a flange 177 of the driver 170 with the heat insulator 185. The coupler hole 185*a* corresponds to a coupler hole 175 of the flange 177. A female thread may be formed inside the coupler hole 185*a* by tapping to connect the driver 170 and the heat insulator 185.

The supporting bracket 197 including the metal material and the heat insulator 185 including the plastic are integrally formed by the insert molding prior to assembly to thereby ease operations of an assembling process of the image forming apparatus 100*c* according aspects of the present invention. That is, whereas, according to the image forming apparatus 100*a* in FIG. 3, in which the heat insulator 181 is inserted between the driver 170 and the supporting bracket 193, according to aspects as shown in FIGS. 7 and 8, the heat insulator 185 is previously assembled with the supporting bracket 197. Thus, the assembling process of the image forming apparatus 100*c* is simplified.

Further, the supporting bracket 197 and the heat insulator 185 may be handled as a single component, thereby reducing component handling costs in manufacturing the image forming apparatus according to aspects as shown in FIGS. 7 and 8.

As described above, an image forming apparatus according to aspects of the present invention may provide the following and/or other benefits: The image forming apparatus may have a lower internal temperature without a forced cooling device, such as a cooling fan. The image forming apparatus may reduce a temperature difference of a photosensitive body. Particularly, the image forming apparatus according to aspects of the present invention has a decreased temperature difference of the photosensitive body in an axial direction of the photosensitive body (i.e., the temperature difference cause by the installation of the driver at one end of the photosensitive body). The image forming apparatus, according to aspects of the present invention, reduces a density difference of an image due to a temperature difference and thereby improves printing quality. The image forming apparatus includes a heat insulator and a supporting bracket formed as a single body which reduces assembling process costs. The image forming apparatus, according to aspects of the present invention, includes an air inlet disposed in a gripping part to receive external air efficiently, and does not require an additional separation from an installation surface.

Although a few embodiments of the present invention have been shown and described, it would be appreciated by those skilled in the art that changes may be made in this embodiment without departing from the principles and spirit of the invention, the scope of which is defined in the claims and their equivalents.

What is claimed is:

1. An image forming apparatus, comprising:

a photosensitive body on which electrostatic latent images are formed;

a driver to drive the photosensitive body;

a supporting bracket to support the driver; and a heat insulator disposed between the supporting bracket and the driver to insulate the photosensitive body from heat generated by the driver.

2. The image forming apparatus of claim 1, wherein the supporting bracket is made of a metal material.

3. The image forming apparatus of claim 1, wherein the photosensitive body comprises a photosensitive drum that rotates about an axial direction;

the supporting bracket is disposed between the driver and the photosensitive body; and the driver is disposed at one end of the axial direction of the photosensitive body.

4. The image forming apparatus of claim 1, wherein the heat insulator is made of plastic.

5. The image forming apparatus according to claim 4, wherein the photosensitive body comprises a photosensitive drum that rotates about an axial direction;

the supporting bracket is disposed between the driver and the photosensitive body; and the driver is disposed at one end of the axial direction of the photosensitive body.

6. The image forming apparatus of claim 1, further comprising a casing to house the driver, the casing comprising an air ventilator to circulate air through the casing.

7. The image forming apparatus of claim 6, wherein the air ventilator comprises an air inlet disposed below the driver to allow the entrance of external air to the air ventilator, and an air outlet disposed in the casing opposite the air inlet to allow the discharge of air to outside the casing.

8. The image forming apparatus of claim 1, wherein the supporting bracket comprises a bracket piece that extends from the supporting bracket toward the driver, and the heat insulator is injection-molded in the bracket piece by plastic.

9. The image forming apparatus of claim 1, wherein the supporting bracket is formed of a plastic, and the heat insulator is integrally formed with the supporting bracket.

10. The image forming apparatus of claim 1, wherein the supporting bracket is made of an insulating material.

11. An image forming apparatus, comprising:

a photosensitive drum on which electrostatic latent images are formed, the photosensitive drum having a rotational shaft;

a driver disposed at an end of the rotational shaft to rotate the photosensitive drum about the rotational shaft;

a supporting bracket disposed between the photosensitive drum and the driver to support the driver; and a heat insulator disposed between the driver and the photosensitive drum to insulate the photosensitive drum from heat generated by the driver, wherein the heat insulator comprises a space that provides an additional insulative layer between the driver and the supporting bracket.

12. The image forming apparatus of claim 11, wherein the heat insulator provides air in the space as the additional insulative layer between the driver and the supporting bracket.

13. The image forming apparatus of claim 11, further comprising a casing to house the photosensitive drum, the driver, the supporting bracket and the heat insulator, wherein the casing comprises an air inlet to allow external air to enter the channel and an air outlet to allow the air to exit the channel to outside the casing, the air passing through the space of the heat insulator.

14. An image forming apparatus, comprising:

a photosensitive drum on which electrostatic latent images are formed, the photosensitive drum having a rotational shaft;

a driver disposed at an end of the rotational shaft to rotate the photosensitive drum about the rotational shaft;

a supporting bracket disposed between the photosensitive drum and the driver to support the driver; and a heat insulator disposed between the driver and the photosensitive drum to insulate the photosensitive drum from heat generated by the driver, wherein the heat insulator provides a channel through which air may move.

15. The image forming apparatus of claim 14, further comprising a casing to house the photosensitive drum, the driver, the supporting bracket, the heat insulator, wherein the casing comprises an air inlet to allow external air to enter the channel and an air outlet to allow the air to exit the channel to outside the casing.

16. The image forming apparatus of claim 15, wherein the casing further comprises:

a grip part disposed at a lower periphery of the casing and elevated from a surface on which the image forming apparatus is placed, wherein the air inlet is formed in the grip part.

17. The image forming apparatus of claim 15, wherein the channel extends from a lower portion of the casing to an upper portion of the casing.

18. The image forming apparatus of claim 15, wherein the air outlet is disposed above the photosensitive drum.

19. The image forming apparatus of claim 14, wherein the channel comprises cooling fins over which the air passes or cooling paths through which the air passes.

20. The image forming apparatus of claim 14, wherein the channel is filled with an insulator and sealed.

21. An image forming apparatus, comprising a photosensitive body on which electrostatic latent images are formed;

a driver disposed at a side of the photosensitive body about a rotational shaft;

a supporting bracket disposed between the photosensitive body and the driver to support the driver; and a heat insulator disposed between the driver and the photosensitive body to decrease a temperature difference between an end of the photosensitive body nearer the driver and an other end of the photosensitive body away from the driver, the decrease in the temperature difference being with reference to when the heat insulator is not used, wherein the heat insulator decreases a temperature difference between the side of the photosensitive body near the driver and a side of the photosensitive body away from the driver to about 1.7° C.

* * * * *